US009126093B1

(12) United States Patent
Hagman

(10) Patent No.: US 9,126,093 B1
(45) Date of Patent: Sep. 8, 2015

(54) SYSTEM FOR RETRACTABLE TENNIS COURT SHADE DEVICE

(71) Applicant: Atlantic Recreation, Inc., Boynton Beach, FL (US)

(72) Inventor: Christopher L. Hagman, Boynton Beach, FL (US)

(73) Assignee: ATLANTIC RECREATION, INC, ;, Boynton Beach, FL (US)

( * ) Notice: Subject to any disclaimer, the term of this patent is extended or adjusted under 35 U.S.C. 154(b) by 18 days.

(21) Appl. No.: 13/761,417

(22) Filed: Feb. 7, 2013

(51) Int. Cl.

| | |
|---|---|
| ***E04H 3/10*** | (2006.01) |
| ***E04F 10/00*** | (2006.01) |
| ***A63B 71/02*** | (2006.01) |
| ***A63G 33/00*** | (2006.01) |
| ***A63B 67/00*** | (2006.01) |
| ***A63B 5/00*** | (2006.01) |
| *A63C 19/12* | (2006.01) |
| *A63B 5/11* | (2006.01) |

(52) U.S. Cl.
CPC ..... *A63B 71/022* (2013.01); *A63B 5/11* (2013.01); *A63B 67/002* (2013.01); *A63B 67/007* (2013.01); *A63C 19/12* (2013.01)

(58) Field of Classification Search
CPC .. A63B 71/022; A63B 67/002; A63B 60/007; A63B 5/11; A63C 19/12
USPC ..... 473/415, 422, 421, 451, 459, 470, 465, 473/480; 135/117; 160/80; 472/94, 92
See application file for complete search history.

(56) References Cited

U.S. PATENT DOCUMENTS

| | | | | | |
|---|---|---|---|---|---|
| 3,053,317 | A | * | 9/1962 | Benson | 160/81 |
| 4,566,475 | A | * | 1/1986 | Wund | 135/99 |
| 4,569,515 | A | * | 2/1986 | Gordon | 473/473 |
| 4,715,598 | A | * | 12/1987 | Knight | 473/470 |
| 5,178,384 | A | * | 1/1993 | Gorman | 473/451 |
| 5,205,564 | A | * | 4/1993 | Lamberti et al. | 273/400 |
| 5,257,481 | A | * | 11/1993 | Reppas et al. | 52/6 |
| 5,437,298 | A | * | 8/1995 | Lin | 135/117 |
| 5,558,145 | A | * | 9/1996 | Baka | 160/67 |
| 5,577,721 | A | * | 11/1996 | Hardee et al. | 473/421 |
| 5,672,125 | A | * | 9/1997 | Ross | 473/421 |

(Continued)

FOREIGN PATENT DOCUMENTS

| | | | | |
|---|---|---|---|---|
| WO | WO 9008869 | A1 * | 8/1990 | E04H 3/10 |
| WO | WO 2014124213 | A1 * | 8/2014 | E04H 3/10 |

*Primary Examiner* — Mitra Aryanpour
(74) *Attorney, Agent, or Firm* — The Concept Law Group, P.A.; Scott D. Smiley; Erin A. Martin

(57) ABSTRACT

A system and method for a retractable tennis court shade device is disclosed. The device is constructed such that it does not substantially impair the play of the game on the tennis court that is being shaded. The device can be constructed substantially along existing fencing structures to surround the entire tennis court, or it can be constructed so that it is parallel to any of the sidelines or baselines or combinations thereof. Alternatively, the device can be constructed such that it is freestanding. The device comprises a frame supported by a plurality of support columns, wherein the frame is disposed at an angle extending inward from the edge of the support columns toward the tennis court while stopping short of completely covering the play area above the tennis court. A plurality of fabric shade panels are retractably attached to the frame, which fabric shade panels filter substantially all of the light and/or UV radiation from the sun. When in place, the fabric shade panels provide shade to a portion of the tennis court which varies over the day.

7 Claims, 11 Drawing Sheets

(56) References Cited

U.S. PATENT DOCUMENTS

| | | | | |
|---|---|---|---|---|
| 5,738,588 | A * | 4/1998 | Esser | 472/92 |
| 5,820,494 | A * | 10/1998 | Gates et al. | 473/421 |
| 6,050,280 | A * | 4/2000 | Jeske | 135/117 |
| 6,550,491 | B1 * | 4/2003 | Bixler et al. | 135/145 |
| 6,666,223 | B2 * | 12/2003 | Price et al. | 135/131 |
| 6,796,359 | B1 * | 9/2004 | Knutson | 160/156 |
| 6,939,255 | B2 * | 9/2005 | Peterson | 473/415 |
| 7,037,220 | B1 * | 5/2006 | Gordon | 473/466 |
| 7,297,076 | B2 * | 11/2007 | Pohrer | 473/421 |
| 8,051,866 | B2 * | 11/2011 | Cutler | 135/117 |
| 8,281,795 | B2 * | 10/2012 | Cutler | 135/117 |
| 8,776,816 | B2 * | 7/2014 | Danziger | 135/147 |
| 2001/0035204 | A1 * | 11/2001 | Lin | 135/87 |
| 2004/0261953 | A1 * | 12/2004 | Hart | 160/80 |
| 2005/0056309 | A1 * | 3/2005 | Bree et al. | 135/147 |
| 2012/0211179 | A1 * | 8/2012 | Cutler et al. | 160/328 |

* cited by examiner

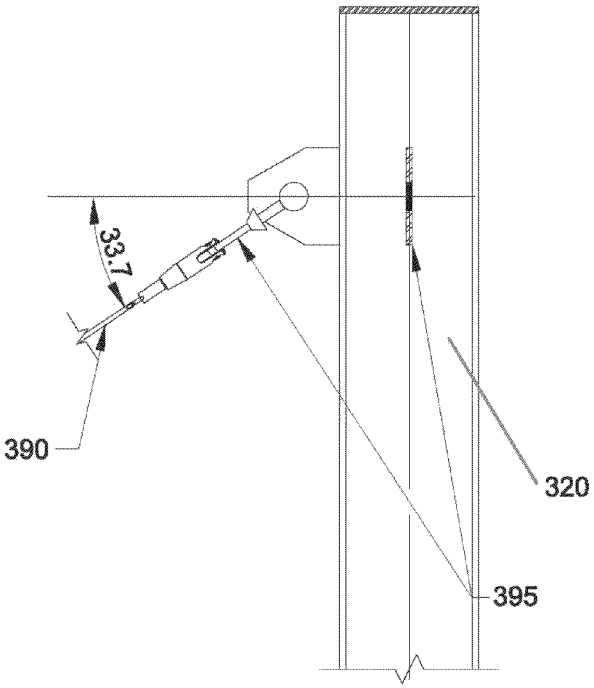
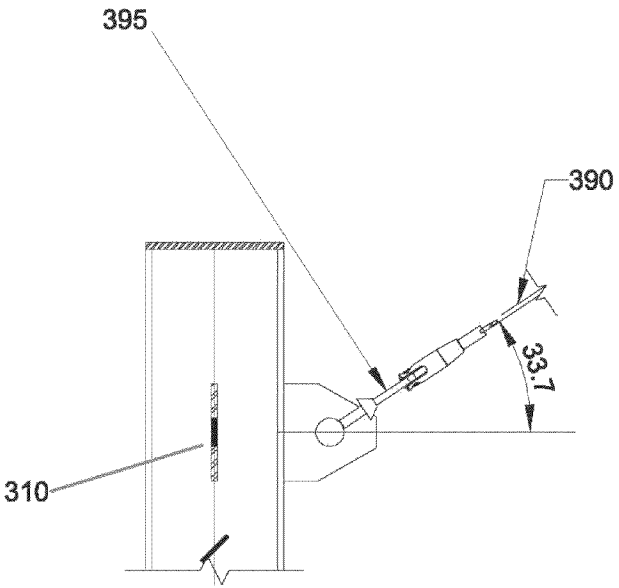
FIG. 3C

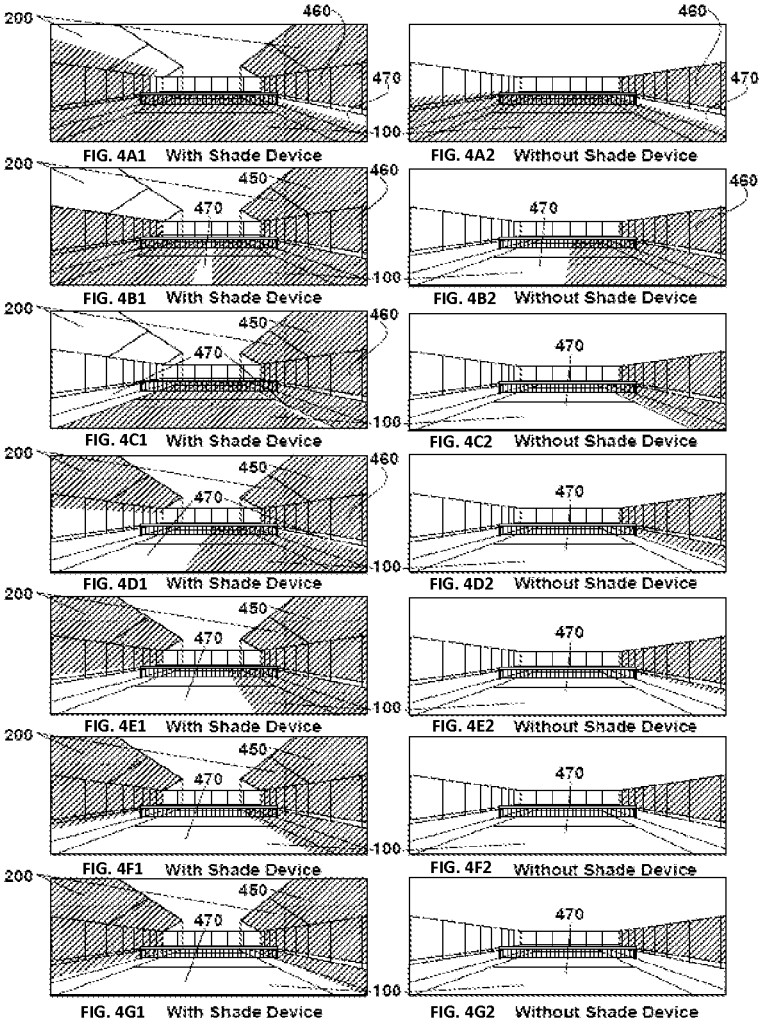
FIG. 4A1 With Shade Device
FIG. 4A2 Without Shade Device
FIG. 4B1 With Shade Device
FIG. 4B2 Without Shade Device
FIG. 4C1 With Shade Device
FIG. 4C2 Without Shade Device
FIG. 4D1 With Shade Device
FIG. 4D2 Without Shade Device
FIG. 4E1 With Shade Device
FIG. 4E2 Without Shade Device
FIG. 4F1 With Shade Device
FIG. 4F2 Without Shade Device
FIG. 4G1 With Shade Device
FIG. 4G2 Without Shade Device

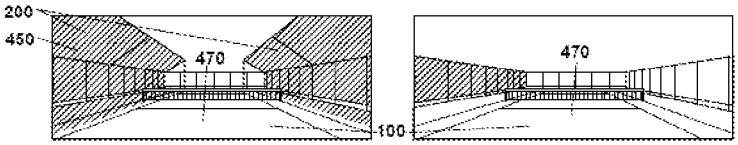
FIG. 4H1 With Shade Device
FIG. 4H2 Without Shade Device
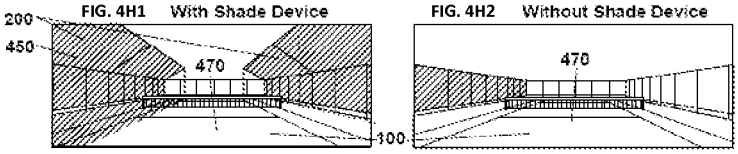
FIG. 4I1 With Shade Device
FIG. 4I2 Without Shade Device
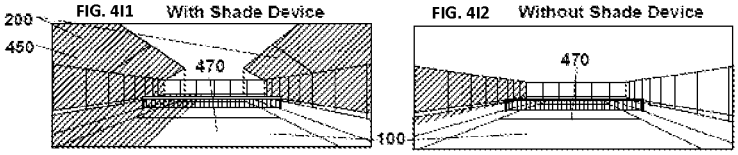
FIG. 4J1 With Shade Device
FIG. 4J2 Without Shade Device
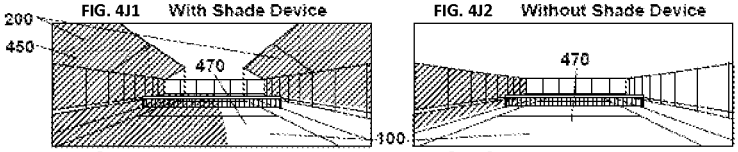
FIG. 4K1 With Shade Device
FIG. 4K2 Without Shade Device
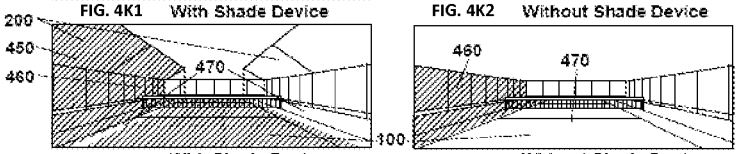
FIG. 4L1 With Shade Device
FIG. 4L2 Without Shade Device
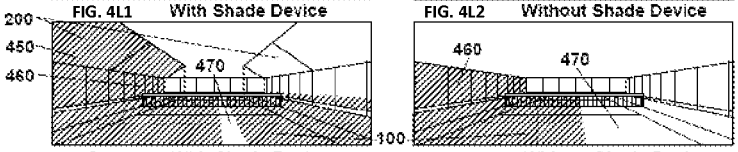
FIG. 4M1 With Shade Device
FIG. 4M2 Without Shade Device
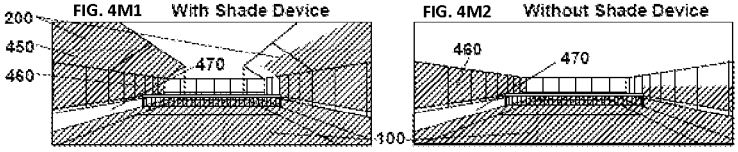
FIG. 4N1 With Shade Device
FIG. 4N2 Without Shade Device 200
550
560
100
570

SYSTEM FOR RETRACTABLE TENNIS COURT SHADE DEVICE

FIELD OF THE INVENTION

The invention relates to a system and method for a retractable tennis court shade device. The device is constructed such that it does not impair or provides limited impairment of the play of the game on the tennis court that is being shaded. The device can be constructed substantially along existing fencing structures to surround the entire tennis court, or it can be constructed so that it is parallel to any of the sidelines or baselines or combinations thereof. Alternatively, the device can be constructed such that it is freestanding. The device comprises a frame supported by a plurality of support columns, wherein the frame is disposed at an angle extending inward toward the tennis court while stopping short of completely covering the play area above the tennis court. A plurality of fabric shade panels are retractably attached to the frame, which fabric shade panels filter substantially all of the light and/or UV radiation from the sun. When in place, the fabric shade panels provide shade to a portion of the tennis court which varies over the day.

BACKGROUND OF THE INVENTION

There are approximately 27 million tennis players in the United States, of which nearly 5 million play 21 times or more per year. Approximately 3.2 million players are youths. Most tennis players spend a lot of time outside in the sun. Accordingly, they run the risk of getting too much sun exposure which can be risky. UVA and UVB rays can cause progressive skin damage that leads to skin cancer, which is the most common type of cancer. More than a million Americans are diagnosed with it each year. The most common forms of skin cancer are basal cell carcinoma (BCC), squamous cell carcinoma (SCC), and melanoma. Although most people develop the less harmful basal cell or squamous cell variety, melanoma can be deadly. The best way to prevent skin cancer is to stay out of the sun, but if you play a sport that takes place in the sun, you are going to be exposed. Each of these has been linked to intermittent and/or chronic sun exposure. Young and small children are especially susceptible to effects of sunlight and heat.

According to the Tennis Industry Association in its most recent TIA National Database Court Report, the total number of tennis courts in the United States is estimated at 270,000. There are significantly more outdoor courts than indoor courts.

Of the ten geographic areas with the highest density of tennis courts per population, nine of those are in southern climates. The area of West Palm Beach-Boca Raton leads in tennis court density with 2.75 total courts and 0.56 public courts per thousand residents, respectively. The only area not in a southern climate in the top ten of tennis court density is Grand Rapids, Mich., with 1.01 total courts and 0.75 public courts per thousand residents, respectively.

Tennis is played on a rectangular flat surface, usually made of grass, clay, asphalt or concrete court. The standard court is 78 feet long and 36 feet wide. Its width is 27 feet for singles matches and 36 feet for doubles matches. The service line is 21 feet from the net. Additional clearance space around the court is needed in order for players to reach overrun balls for a total of 60 feet wide and 120 feet long. A net is stretched across the full width of the court, parallel with the baselines, dividing it into two equal ends. The net is 3 feet 6 inches high at the posts, and 3 feet high in the center. Often a fencing structure surrounds a tennis court or a group of tennis courts. Typically fencing or walls around an outside court are a minimum of 8 feet high for residential courts and 10 feet for clubs or park facilities.

In 2012, the official rules and court dimensions for children aged 10 and under changed. Children 8 and under now play on a court that is 36 feet in length, which can be positioned laterally on a standard tennis court. Children 9 and 10 years old play on a court that is 60 feet in length which can be positioned within a standard court.

The area above the tennis court should be free from overhead obstruction. For indoor courts, the minimum overhead clearance free of any obstructions should be at least 20 feet above the baseline and 35 feet above the net.

While total sun exposure is dependent on the geographic location of an outdoor tennis court, the time of year, its orientation and cloud cover, outdoor tennis players are exposed to sun largely depending on the time of day. For persons such as instructors who spend a large amount of their day on the court, they are potentially exposed to a significant amount of sun over the entire day. While some persons are more susceptible to sunburn than others, all persons can experience negative effects from sun exposure if exposed for extended times. It is not always necessary during tennis instruction for the entire playing surface of the tennis court to be available, and certain lessons can be provided using only a portion of the court.

Additionally, while the temperature in the shade is the same as the temperature in a sun-exposed area, direct sunlight makes a person feel warmer because electromagnetic radiation is being embedded directly into the skin. Thus, a person standing in direct sunlight feels warmer than if standing in the shade.

U.S. Pat. No. 4,280,306 to Milinic and titled CONVERTIBLE ENCLOSURE FOR BUILDINGS AND AREAS discloses a convertible tennis-court enclosure, comprising a plurality of parallel supporting beams and two closure elements between two of the supporting beams to be extended simultaneously along the supporting beams, each element including a series of purlins arranged to slide on the supporting beams and connected in two's by a portion of a canvas fixed to the purlins, of which the length is equal to half that of the beams.

U.S. Pat. No. 8,281,795 to Cutler and titled RETRACTABLE AWNING discloses a retractable awning, comprising a screen which may be extended and retracted, wherein there is provided a first motor arranged to extend the screen, a second motor arranged to retract the screen, and a control unit arranged to control the first and second motors, wherein the first and second motors are synchronized so as to maintain tension in the screen within predetermined values.

U.S. Patent Application Publication No. US 2004/0089426 to Cosgrove and titled SHADE AND PRIVACY EXTENSION ACCESSORY discloses a screen panel to improve privacy, shade, and aesthetic properties of a rigid barrier fence or wall or an outdoor patio. The screen panel has visual and audio impairment properties that extends upward from the top of a barrier wall and effectively increases the overall wall height. Other embodiments affix a shade or aesthetic combination accessory from a barrier fence or wall, roof, or roof support member.

U.S. Patent Application Publication No. 2004/0261953 to Hart and titled SAIL SHAPED AWNINGS discloses sail shaped awnings, and particularly to attached or freestanding awnings that use tensioned flexible fabric to protect against the sun, wind, rain, hail and other weather conditions. Such awnings may also incorporate fire fighting characteristics. In one aspect, the invention resides in a sail shaped awning attached to a building structure, and at least one remote support or column having at least one wire or cable for tensioning the awning, is connected to the roof or roof support assembly so as to apply a downward, restraining force.

Preferably, outer edge(s) of the tensioned awning fabric connected to at least one remote support or column are raised or lowered to assist in holding down the roof and to keep out debris during high winds. The outer edge(s) may be connected to hoisting cables or chains connected to winches on the remote support or column, or to telescopic columns.

U.S. Patent Application Publication No. 2012/0211179 to Cutler et al. and titled COVERING SYSTEM discloses a retractable covering system including a screen that is movable between a retracted and an extended configuration and at least two tensioning members attached to a leading edge of the screen and arranged to pull the screen in opposite transverse directions so as to create transverse tension in the screen.

Japanese Laid Open Patent Application No. JP8260739 to Yamamoto et al. and titled MEMBRANEOUS STRUCTURE FOR SPORTS FACILITIES discloses a structure to provide sports facilities with good ventilation and soft transmission of sunlight having a roof and wall made out of membranous material having specified total light transmittance, where there are multiple openings in the circumferential areas. By use of a composite membranous material in which cloth made of polyethylene-terephthalate fiber is coated with semitransparent polyvinyl chloride resin, and the total light transmittance is in the range of 14-70%, an arch-shaped skeleton is coated from one end part of the structure to the other end. This membranous structure is built over a tennis court, and the faces corresponding to the lateral direction of the court are not covered with the membranous material so as to be open. The tennis court is thus well-ventilated and cool by shade in summer, and in winter the sunlight is transmitted so as to be warm, and hence tennis can be comfortably played.

The En-Fold™ roof available from Uni-Systems, LLC (Minneapolis, Minn.) is a high performance retractable tensile structure designed specifically for large commercial applications such as outdoor dining areas, outdoor event centers, pool decks and sports facilities.

SUMMARY OF THE INVENTION

The invention relates to a system and method for a retractable tennis court shade device. The device is constructed such that it does not impair or provides limited impairment of the play of the game on the tennis court that is being shaded. The device can be constructed substantially along existing fencing structures to surround the entire tennis court, or it can be constructed so that it is parallel to any of the sidelines or baselines or combinations thereof. Alternatively, the device can be constructed such that it is freestanding. The device comprises a frame supported by a plurality of support columns, wherein the frame is disposed at an angle extending inward toward the tennis court while stopping short of completely covering the play area above the tennis court. A plurality of fabric shade panels are retractably attached to the frame, which fabric shade panels filter substantially all of the light and/or UV radiation from the sun. When in place, the fabric shade panels provide shade to a portion of the tennis court which varies over the day. The device can be used in conjunction with fencing with windscreen to provide additional shading.

In one embodiment, the frame comprises a plurality of frame arms which are supported at one end by a plurality of base support columns installed around the exterior of the doubles sidelines and/or baselines of a tennis court, and at the other end by a plurality of frame support columns installed aligned with the singles or doubles sideline and/or baselines of the tennis court.

In one embodiment, the base support columns are not aligned with the singles or doubles sideline and/or baselines of the tennis court.

In one embodiment, the frame arms are supported at one end by existing fencing posts installed around the exterior of the tennis court and at the other end by frame support columns installed aligned with the singles or doubles sideline and/or baselines of the tennis court.

The frame arms extend from the top of the base support columns (or fencing posts) and extend inwardly toward the tennis court. In one embodiment, the frame arms are installed such that they extend inwardly toward the tennis court while not covering any part of the playing area of the tennis court. In one embodiment, the frame arms are installed such that they extend inwardly toward the tennis court and cover a portion but not all of the playing area of the tennis court.

In one embodiment, one end of one or more frame arms is supported by a frame support column that has been installed at each end of the tennis court, substantially in line with the singles or doubles sidelines of the tennis court. In one embodiment, one or more of the ends of the frame arms are not supported at all.

One or more fabric shade panels are attached to the frame. The fabric shade panels provide shading from the sun when extended, but can be retracted when desired. In one embodiment, the fabric shade panels are attached to steel cables which are attached to the frame arms. In one embodiment, the retraction of the fabric shade panel is manual. In one embodiment, a motor is used to retract the fabric shade panel.

When in use, the retractable tennis court shade device makes persons playing on the court feel cooler than if standing directly in the sunlight. Further, the retractable tennis court shade device provides some wind and rain protection to the tennis court.

BRIEF DESCRIPTION OF THE DRAWINGS

The invention will be described with reference to the accompanying drawings, in which like elements are referenced with like numerals.

FIG. 3C depicts a side view of one embodiment of a steel cable strung between a base support column and a frame support column to which a fabric shade panel can be attached.

FIGS. 4A1 to 4N2 depict simulations of the shading on a tennis court equipped with a retractable tennis court shade device according to one embodiment of the invention compared to the same court without a retractable tennis court shade device located in Daytona Beach, Fla. on Jun. 21, 2012 on a sunny day, showing the shading on the court over the day.

DETAILED DESCRIPTION OF THE INVENTION

Figure 1:
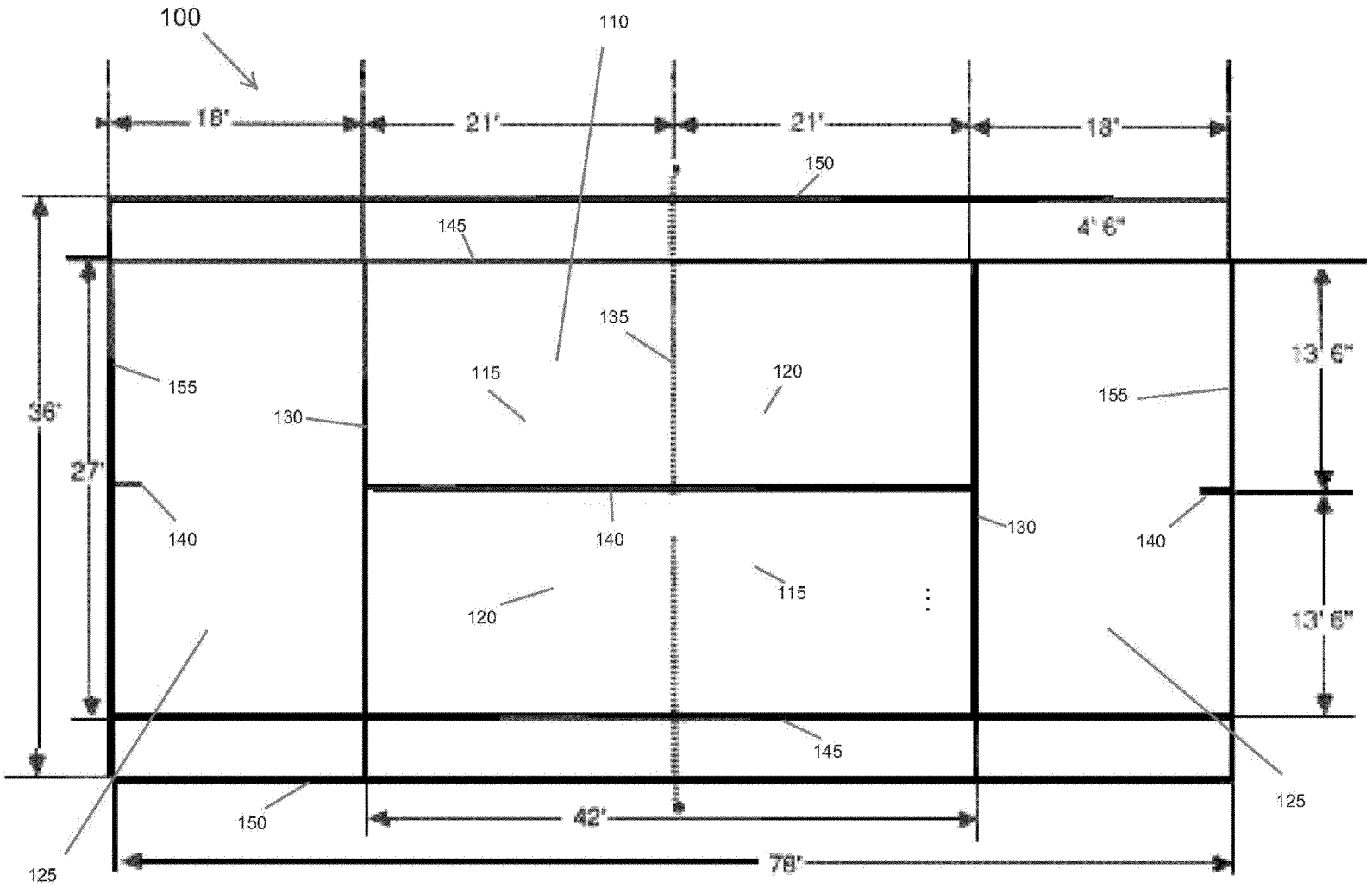
FIG. 1 depicts a diagram of a standard tennis court.

The invention relates to a system and method for a retractable tennis court shade device. The device is constructed such that it does not impair or provides limited impairment of the play of the game on the tennis court that is being shaded. The device can be constructed substantially along existing fencing structures to surround the entire tennis court, or it can be constructed so that it is parallel to any of the sidelines or baselines or combinations thereof. Alternatively, the device can be constructed such that it is freestanding. The device comprises a frame supported by a plurality of support columns, wherein the frame is disposed at an angle extending inward toward the tennis court while stopping short of covering the play area above the tennis court. A plurality of fabric shade panels are retractably attached to the frame, which fabric shade panels filter substantially all of the light and/or UV radiation from the sun. When in place, the fabric shade panels provide shade to a portion of the tennis court which varies over the day.

While the description provided herein may refer to a standard tennis court, the principles of the invention can be applied to a tennis court of any size. Further, the principles of the invention can be applied to any outdoor surface where shading is desired, including sports playing surfaces and non-sports surfaces such as parks, playgrounds and pools. The principles of the invention are not to be limited to the description provided below as can be appreciated by a person having ordinary skill in the art of designing sports playing surfaces and other outdoor surfaces.

When in use, the retractable tennis court shade device makes persons playing on the court feel cooler than if standing in the sunlight. Further, the retractable tennis court shade device provides some wind and rain protection to the tennis court.

In one embodiment, existing tennis courts can be retrofitted with the retractable tennis court shade device to provide shading from harmful sun exposure to tennis players. In this embodiment, a plurality of base support columns is installed along the exterior of the doubles or singles sidelines and/or baselines along which the retractable tennis court shade device is to stand. The base support columns can be installed substantially along existing fencing surrounding the tennis court, where such fencing exists. Additionally, frame support columns can be installed along the exterior of the doubles or singles sidelines and/or baselines along which the retractable tennis court shade device is to stand. The base of each base support and frame support column can be installed according to local building standards, and may require footings or other foundational supports. The type of foundational support that is required for the base support and frame support columns can be determined by the installer of the retractable tennis court shade device and is not intended to limit the invention in any manner. In one embodiment, three base support columns are used. In other embodiments, the number of base columns to install is determined by the user.

In one embodiment, the retractable tennis court shade device can be designed to cover none or a portion of the tennis court, according to the design specifications of the user. The amount of shading provided by the retractable tennis court shade device is equivalent to the shadow cast over the playing surface of the tennis court by the fabric shade panels which will vary according to the size and degree of inclination of the fabric shade panels, the weather conditions and the positioning of the sun with respect to the tennis court that is being shaded.

The height of each support column can be determined by the installer, and may depend on the geographic location and orientation of the tennis court that is to be shaded. The height will also vary depending on whether the support column is a base support column or a frame support column. For example, an installer may determine how much shading from sun exposure he/she wants to limit on the tennis court playing surface when designing the height of the support columns. In one embodiment, the base support columns are about 12 feet in height and the frame support columns are about 20 feet in height. In one embodiment, the base support columns are the same height as the vertical supports for fencing that may surround the tennis court. In one embodiment, the support columns have an outer diameter of about 2 feet. In one embodiment, the support columns comprise hollow structural section (HSS).

In one embodiment, the retractable tennis court shade device can be attached to existing posts for fencing, where present, depending on whether the existing posts can structurally support the device.

The frame comprises a plurality of frame arms supported at their proximal ends by the base support columns. One or more of the frame arms may be supported at their distal ends by frame support columns. The proximal ends of each of the frame arms are attached at the upper end of the base support columns and extend inwardly toward the tennis court at an angle and distance determined by the installer. The determination of the angle of the attachment of the frame arms to the base support columns can depend on such factors as strength, design considerations such as the upper limit of wind tolerance and the amount of sun that is to be shaded by the fabric shade panel that will be attached to the frame. When installed in any given location, the angle formed by the attachment of the frame arms to the base support columns and the length of the frame arms determines the amount of the court that will be exposed to sunlight which will vary according to weather conditions and time of year for that particular court. By selecting the angle of attachment of the frame arms to the base support columns and the length of the frame arms, the user determines the amount of shade coverage for that particular court.

In one embodiment, the distal ends of the frame arms are each supported by a frame support column that has been installed at the exterior of each end of the tennis court, substantially in line with the doubles sidelines of the tennis court. In one embodiment, the distal ends of the frame arms are each supported by a frame support column that has been installed at the exterior of each end of the tennis court, substantially in line with the baselines of the tennis court. In one embodiment, the distal ends of one or more frame arms are supported by a frame support column that has been installed at the exterior of each end of the tennis court, substantially in line with the doubles or singles sidelines and/or baselines of the tennis court, and the distal ends of one or more frame arms may not be supported by a frame support column. For example, in one embodiment, the frame may comprise a frame arm disposed substantially in line with the centerline of the tennis court and which is supported at its proximal end to the top of a base support column but is not supported at its distal end by a frame support column. Further, in one embodiment, the frame may comprise a frame arm disposed substantially in line with the net of the tennis court and which is supported at its proximal end to the top of a base support column but is not supported at its distal end by a frame support column.

In one embodiment, the frame arms comprise hollow structural section (HSS). In one embodiment, the frame arms are attached to the base support columns and frame support columns.

In one embodiment, one or more fabric shade panels are attached to the frame which provides shading to the tennis court from the sun. In one embodiment, one fabric shade panel is disposed between any two frame arms. In one embodiment, a plurality of fabric shade panels can be attached and disposed between any two frame arms. The fabric shade panels can be manufactured using polypropylene mesh or any other material as determined by the installer. The fabric shade panels in one embodiment can be retracted when desired. For example, where the wind speed is estimated to or in fact exceeds a certain limit, the fabric shade panels can be retracted to avoid damage or injury to the fabric shade panels, to the frame arms, to the tennis court or to persons in the vicinity of the tennis court.

In one embodiment, one steel cable is strung between each frame arm substantially along the bottom edge of each fabric shade panel and one steel cable is strung between each frame arm substantially along the top edge of each fabric shade panel. In one embodiment, the steel cable is ⅜ inch in diameter. In one embodiment, the fabric shade panels comprise eyelets at the bottom edge and the top edge. In one embodiment, a ring is disposed in each eyelet through which the steel cable(s) are strung. In one embodiment, each fabric shade panel is fixedly attached along one side to a frame arm and the fabric shade panel can be drawn along the steel cables toward the adjacent frame arm in order to open or retract the fabric shade panel. In one embodiment, each fabric shade panel is fixedly attached along one side to a steel cable that extends between the base support columns and frame support columns by way of a full pin moment connection and using anchor rods with clevises, and the fabric shade panel can be drawn along the steel cables toward the adjacent frame arm in order to open or retract the fabric shade panel. In one embodiment, the user can attach a tool to one end of a fabric shade panel and draw it over the steel cables in order to retract or open the fabric shade panel. In one embodiment, one or more straps can be attached to one end of a fabric shade panel which can be used to draw the fabric shade panel over the steel cables in order to retract or open the fabric shade panel. The strap can then be secured by means of hook and loop fasteners or any other means now known or later developed.

In one embodiment, a single fabric shade panel retracts laterally along the entire length and/or width of the tennis court, depending on the installation of the retractable tennis court shade device. In one embodiment, a single fabric shade panel retracts vertically along the entire length and/or width of the tennis court. In one embodiment, two fabric shade panels retract laterally, with each fabric shade panel covering about one-half of the length of the tennis court. In one embodiment, two fabric shade panels retract vertically, with each fabric shade panel covering about one-half of the length and/or width of the tennis court. In one embodiment, four fabric shade panels retract laterally, with each fabric shade panel covering about one-fourth of the length of the tennis court. In this embodiment, the two exterior fabric shade panels retract toward the outer edges of the tennis court, and the two interior fabric shade panels retract toward the center of the tennis court and toward the frame support column disposed at the center of the tennis court. In one embodiment, four fabric shade panels retract vertically, with each fabric shade panel covering about one-fourth of the length and/or width of the tennis court.

In one embodiment, the retraction of the fabric shade panels is manual. In one embodiment, a motor is used to retract the fabric shade panels.

In one embodiment, the retractable tennis court shade device can be installed in conjunction with mesh windscreens which are commonly installed over fencing surrounding tennis courts. The mesh windscreens provide protection against wind and also provide some shade protection at certain angles of the sun with respect to the tennis court. When used in conjunction with each other, it is possible to protect a large portion of the playing surface of a tennis court with shade and thus protect from sun exposure for a majority of the day.

Turning to the figures, FIG. 1 depicts a diagram of a standard tennis court 100. The tennis court 100 comprises a forecourt 110 comprising two left service courts 115 and two right service courts 120; two backcourts 125; two service lines 130; a net 135; a center line 140; two singles sidelines 145; two doubles sidelines 150; and two baselines 155. Forecourt 110 is 42 feet long and is bifurcated in length by net 135. Net 135 is 3 feet 6 inches high at the posts, and 3 feet high in the center of forecourt 110. Backcourts 125 are each 18 feet in length. Baselines 155 at each end of backcourts 125 mark the boundary for play at each end of tennis court 100. Centerline 140 longitudinally bifurcates forecourt 110 and backcourts 125. For singles play, singles sidelines 145 mark the side boundaries of play. For doubles play, doubles sidelines 150 mark the side boundaries of play. Singles sidelines 145 are located 27 feet from each other and are bifurcated by centerline 140. Doubles sidelines 150 are located 36 feet from each other and are bifurcated by centerline 140. If fencing is present around tennis court 100, it should provide room for play of about 60 feet across and 120 feet in length.

Figure 2A:
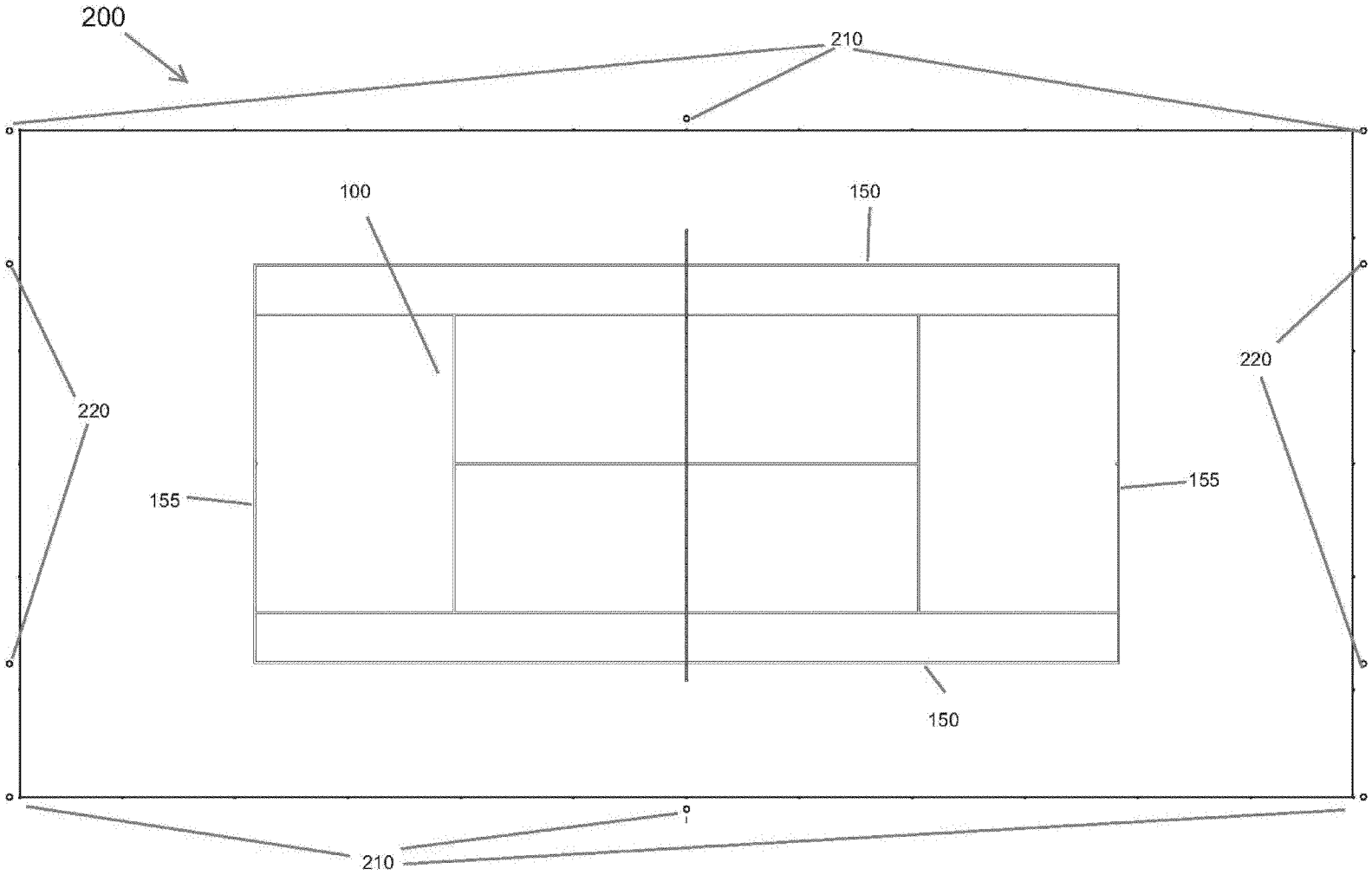
FIG. 2A depicts an overhead view of a tennis court to which a retractable tennis court shade device will be installed according to one embodiment of the invention.

FIG. 2A depicts an overhead view of a tennis court 100 to which a retractable tennis court shade device 200 will be installed according to one embodiment of the invention. In this embodiment, three base support columns 210 are located parallel to the exterior of each doubles sideline 150 of tennis court 100. Two frame support columns 220 are located parallel to the exterior of each baseline 155 of tennis court 100 and in line with each doubles sidelines 150.

Figure 2B:
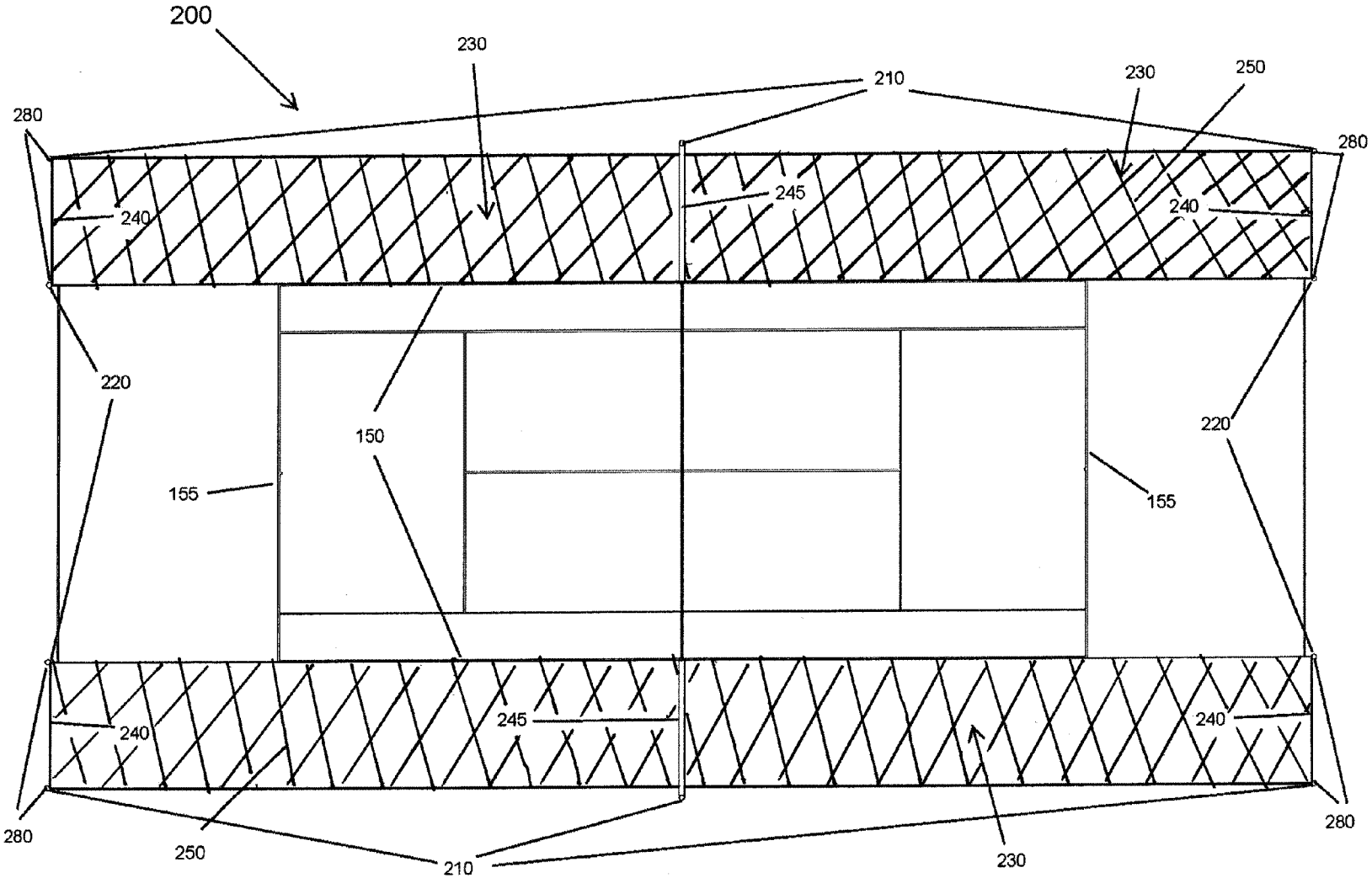
FIG. 2B depicts an overhead view of a tennis court with a retractable tennis court shade device according to one embodiment of the invention.

FIG. 2B depicts an overhead view of a tennis court 100 with a retractable tennis court shade device 200 according to one embodiment of the invention. In this embodiment, base support columns 210 are located parallel to the exterior of each doubles sideline 150 of tennis court 100. Two frame support columns 220 are located parallel to the exterior of each baseline 155 of tennis court 100 and in line with each doubles sideline 150. Each frame 230 comprises frame arms 240 which are supported at their proximal ends by base support columns 210, and which also are supported at their distal ends by frame support columns 220. In this embodiment, each frame 230 further comprises center frame arm 245 which is supported solely at its proximal end by center base support column 210. Fabric shade panels 250 are attached at each edge to steel cables 280 that extend laterally across frame 230.

Figure 2C:
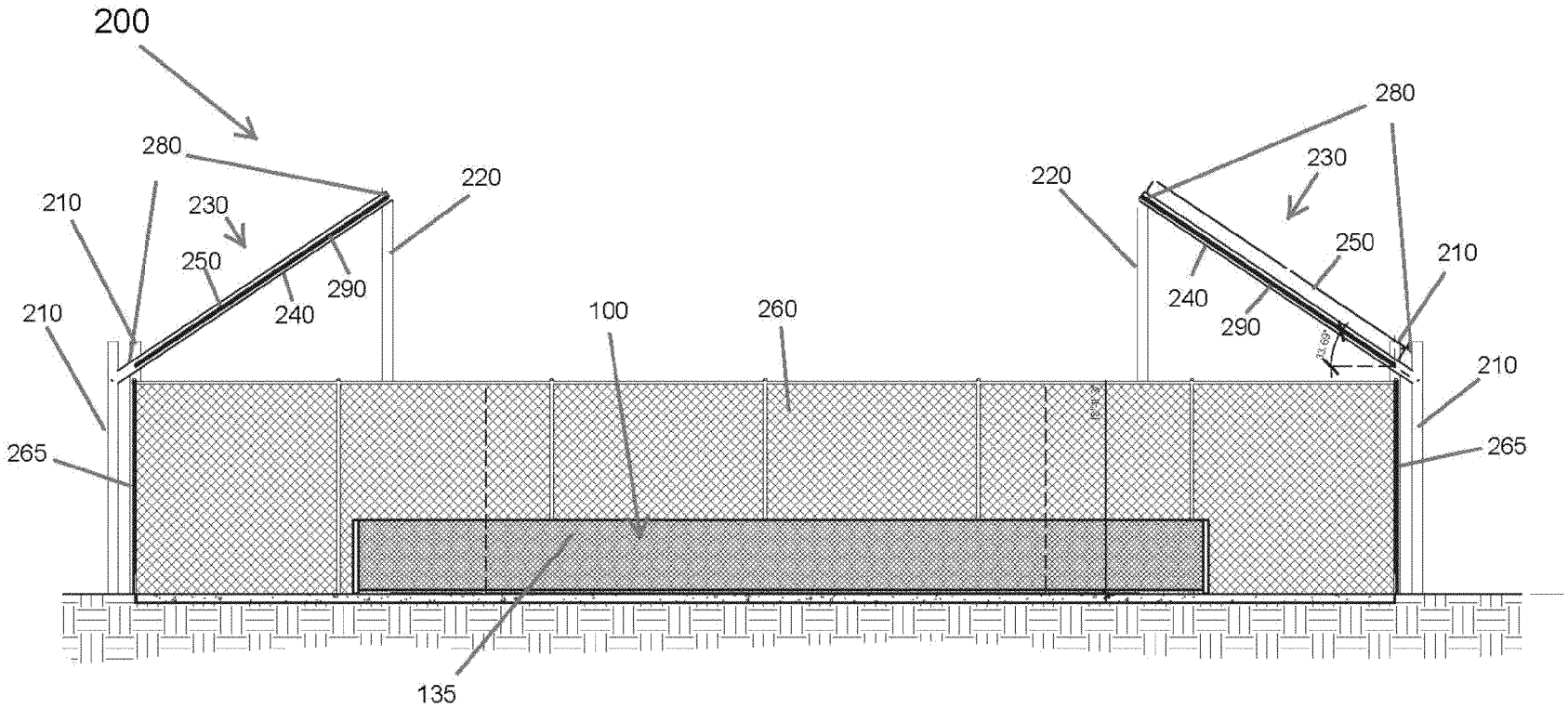
FIG. 2C depicts an end view of a tennis court with a retractable tennis court shade device according to one embodiment of the invention.

FIG. 2C depicts an end view of a tennis court 100 with retractable tennis court shade device 200 according to one embodiment of the invention. Frame arms 240 are supported at their proximal ends by base support columns 210 and at their distal ends by frame support columns 220. Fabric shade panels 250 are attached at each bottom edge and top edge to steel cables 280. Steel cables 280 extend laterally across frame 230. Fabric shade panels 250 can be extended across frame 230 or retracted toward one end of tennis court 100. Base support columns 210 are installed substantially alongside fencing support columns 265, which support fencing 260 surrounding tennis court 100. In one embodiment, steel cables 290 extend between the top of base support columns 210 and the top of frame support columns 220 that are disposed at the outer edges of tennis court 100, and the ends of fabric shade panels 250 that are disposed toward the outer edges of tennis court 100 are attached to steel cables 290.

Figure 3A:
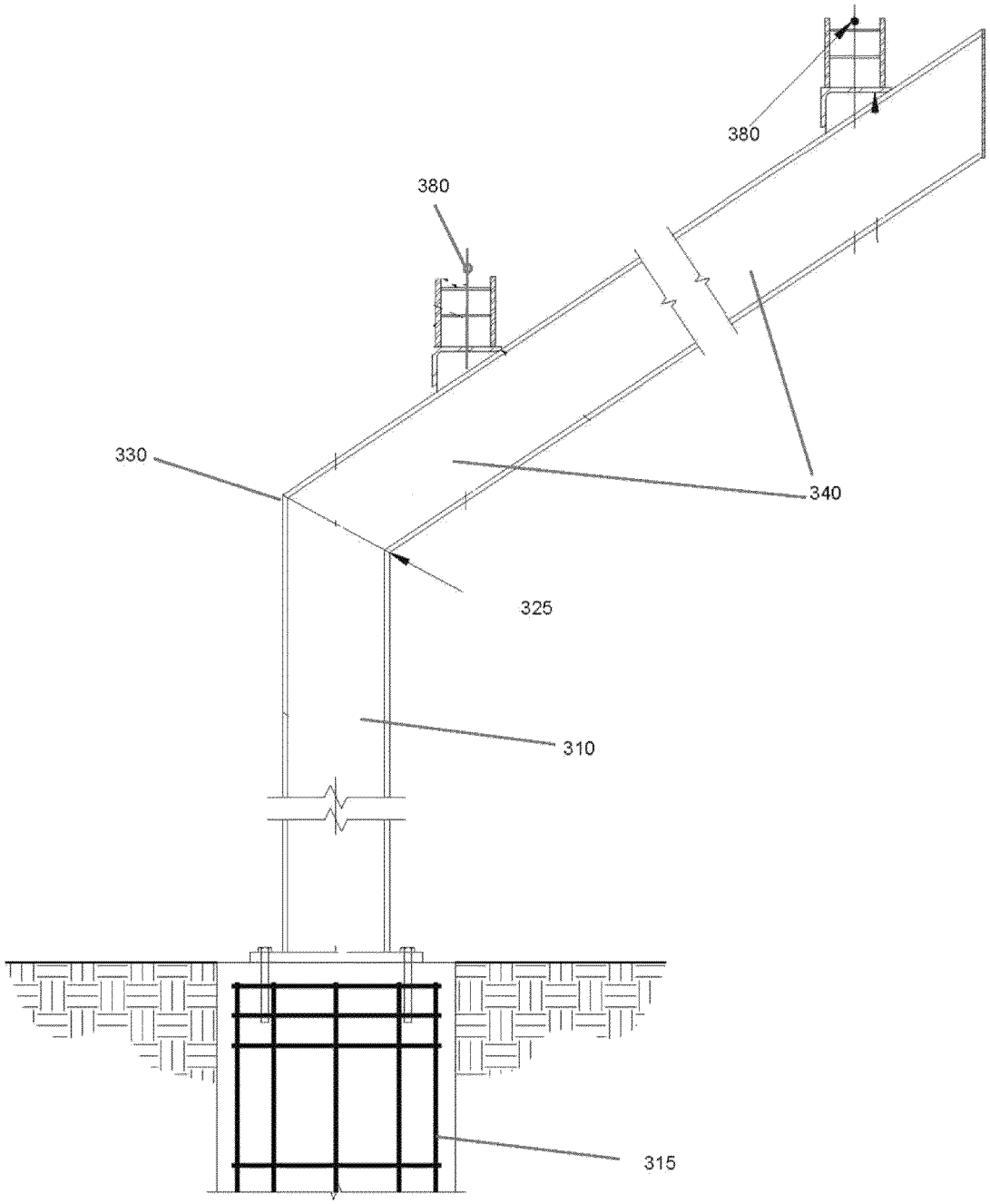
FIG. 3A depicts a side view of a base support column and a frame arm of a retractable tennis court shade device according to one embodiment of the invention.

FIG. 3A depicts a side view of a base support column 310 and a frame arm 340 of a retractable tennis court shade device according to one embodiment of the invention. Base support column 310 is supported at its base by a foundation 315. Each frame arm 340 is attached at its proximal end 325 to the upper end 330 of base support column 310. Steel cables 380 are extended between adjacent frame arms 340 to which one end of each fabric shade panel (not shown) can be fixedly attached.

Figure 3B:
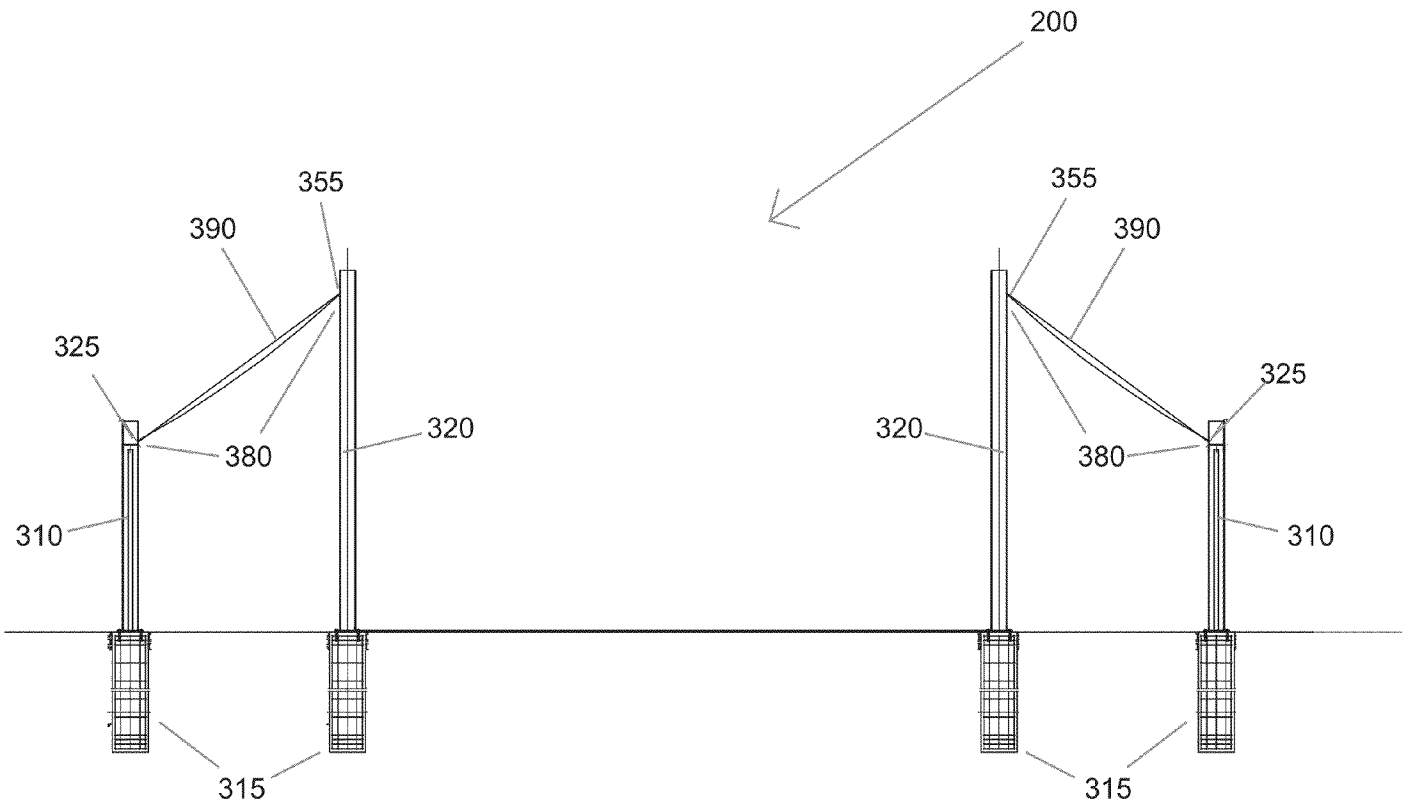
FIG. 3B depicts a side view of the end elevation of a retractable tennis court shade device according to one embodiment of the invention.

FIG. 3B depicts a side view of the end elevation of a retractable tennis court shade device according to one embodiment of the invention. Base support columns 310 and frame support columns 320 are supported at their bases by foundations 315. Steel cables 380 are strung laterally between adjacent base support columns 310 and frame support columns 320 to which fabric shade panels can be attached. Steel cables 390 are strung between top of base support columns 310 and top of frame support columns 320 to which one end of each fabric shade panels (not shown) can be fixedly attached.

FIG. 3C depicts a side view of one embodiment of a steel cable 390 strung between a base support column 310 and a frame support column 320 to which one end of a fabric shade panel (not shown) can be fixedly attached according to one embodiment of the invention. Steel cable 390 is attached at one end to base support column 310 by way of an anchor rod with clevis 395. Steel cable 390 is likewise attached to frame support column 320 by way of an anchor rod with clevis 395.

Figure 3D:
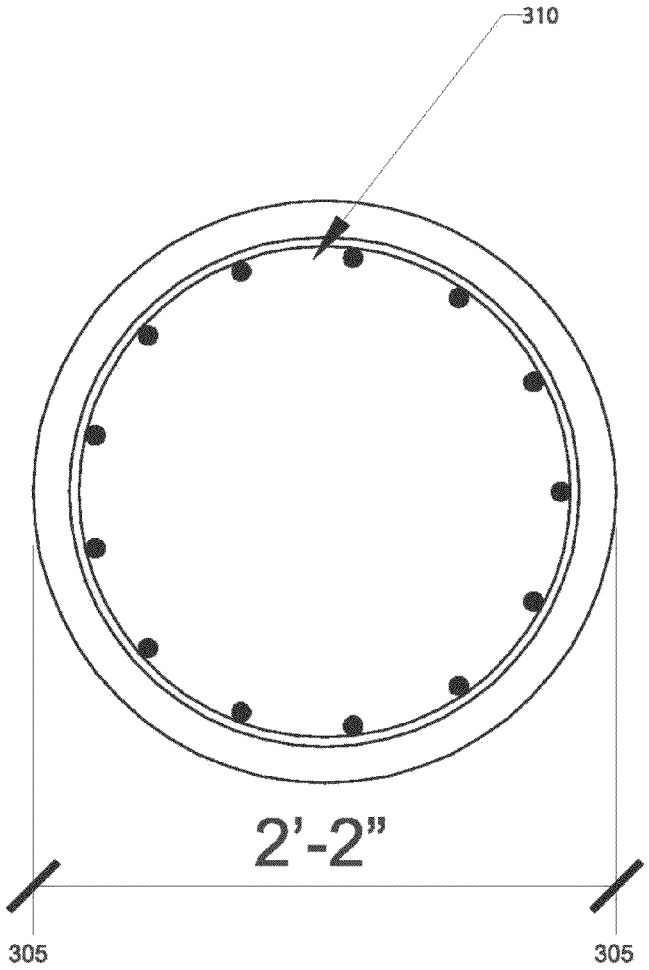
FIG. 3D depicts a top view of a support column of a retractable tennis court shade device according to one embodiment of the invention.

FIG. 3D depicts a top view of a base support column 310 of a retractable tennis court shade device according to one embodiment of the invention. Base support column 310 comprises HSS and has an outer diameter as measured between opposing points 305 of about 2 feet 2 inches.

FIGS. 4A1 to 4N2 depict a simulation of the shading on a tennis court 100 located in Daytona Beach, Fla. on Jun. 21, 2012 on a sunny day equipped with a retractable tennis court shade device 200 according to one embodiment of the invention compared to the same court without a retractable tennis court shade device. Beginning at 7 am in FIG. 4A1 and 4A2, tennis court 100 is substantially shaded, with a small amount of sun 470 shining through the opening between the bottom of fencing with windscreen 460 and tennis court surface 100. At 8 am in FIG. 4B1, tennis court 100 with retractable tennis court shade device 200 remains substantially shaded from sun 470, which at this point in the day shines through the opening between the top of fencing with windscreen 460 and the bottom of fabric shade panel 450. In contrast, with reference to FIG. 4B2, slightly less than one half of the playing surface of tennis court 100 without a retractable tennis court shade device is shaded from sun 470 shining through the opening above court 100 by this point in the day with shade provided only by fencing with windscreen 460. At 9 am in FIG. 4C1, tennis court 100 with retractable tennis court shade device 200 remains substantially shaded by fabric shade panel 450, with a small portion of court 100 exposed to sun 470 shining through the opening between the top of fencing with windscreen 460 and the bottom of fabric shade panel 450. The shade begins to decrease on tennis court 100 from sun 470 shining above fabric shade panel 450. In contrast, with reference to FIG. 4C2 the playing surface of tennis court 100 without a retractable tennis court shade device at this point in the day is nearly completely exposed to sun 470 shining through the opening above court 100 with only a small portion of court 100 shaded by fencing with windscreen 460. At 10 am in FIG. 4D1, approximately one half of tennis court 100 with retractable tennis court shade device 200 remains shaded by fabric shade panel 450 from sun 470 shining on court 100 through the opening above court 100. With reference to FIG. 4D2, none of the playing surface of tennis court 100 without a retractable tennis court shade device is shaded at this point in the day but is completely exposed to sun 470 shining through the opening above court 100. At 11 am in FIG. 4E1, about one third of tennis court 100 with retractable tennis court shade device 200 is shaded by fabric shade panel 450 from sun 470 shining through the opening above court 100. With reference to FIG. 4E2, none of the playing surface of tennis court 100 without a retractable tennis court shade device is shaded and court 100 remains completely exposed to sun 470 shining through the opening above court 100. At 12 pm in FIG. 4F1, about one quarter of tennis court 100 with retractable tennis court shade device 200 is shaded by fabric shade panel 450 from sun 470 shining through the opening above court 100. In contrast, with reference to FIG. 4F2, none of the playing surface of tennis court 100 without a retractable tennis court shade device is shaded and court 100 remains completely exposed to sun 470 shining through the opening above court 100. By 1 pm in FIG. 4G1, very little of tennis court 100 with retractable tennis court shade device 200 is shaded from sun 470 shining through the opening above court 100. With reference to FIG. 4G2, none of the playing surface of tennis court 100 without a retractable tennis court shade device is shaded at this point in the day and court 100 remains completely exposed to sun 470 shining through the opening above court 100. At 2 pm in FIG. 4H1, very little shade is provided to tennis court 100 with retractable tennis court shade device 200 by fabric shade panel 450 and court 100 is exposed to sun 470 shining through the opening above court 100. With reference to FIG. 4H2, none of the playing surface of tennis court 100 without a retractable tennis court shade device is shaded at this point in the day and court 100 remains completely exposed to sun 470 shining through the opening above court 100. At 3 pm in FIG. 4I1, almost one quarter of tennis court 100 with retractable tennis court shade device 200 is shaded by fabric shade panel 450 from sun 470 shining through the opening above court 100. With reference to FIG. 4I2, none of the playing surface of tennis court 100 without a retractable tennis court shade device is shaded and court 100 remains completely exposed to sun 470 shining through the opening above court 100. By 4 pm in FIG. 4J1, about one third of tennis court 100 with retractable tennis court shade device 200 is shaded by fabric shade panel 450 from sun 470 shining through the opening above court 100. With reference to FIG. 4J2, none of the playing surface of tennis court 100 without a retractable tennis court shade device is shaded from sun 470 shining through the opening above court 100. At 5 pm in FIG. 4K1, over one half of tennis court 100 with retractable tennis court shade device 200 is shaded by fabric shade panel 450 from sun 470 shining through the opening above the court. With reference to FIG. 4K2, none of the playing surface of tennis court 100 without a retractable tennis court shade device is shaded and court 100 remains completely exposed to sun 470 shining through the opening above court 100. By 6 pm in FIG. 4L1, nearly all of tennis court 100 with retractable tennis court shade device 200 is shaded by fabric shade panel 450 from sun 470 shining through the opening above the court, with some sun 470 also shining through the opening between the top of fencing with windscreen 460 and bottom of fabric shade panel 450. With reference to FIG. 4L2, very little of the playing surface of tennis court 100 without a retractable tennis court shade device is shaded and largely remains exposed to sun 470 shining through the opening above court 100, with a small amount of shade provided by fencing with windscreen 460. At 7 pm in FIG. 4M1, tennis court 100 with retractable tennis court shade device 200 is completely shaded by fabric shade panel 450, with a small portion of court 100 exposed to sun 470 shining through the opening between the top of fencing with windscreen 460 and the bottom of fabric shade panel 450. With reference to FIG. 4M2, about one half of the playing surface of tennis court 100 without a retractable tennis court shade device is shaded from sun 470 by fencing with windscreen 460. By 8 pm in FIG. 4N1 and 4N2, tennis court 100 with and without retractable tennis court shade device 200, respectively, are completely shaded by fencing with windscreen 460.

Thus, over the day, a majority of the playing surface of tennis court 100 with retractable tennis court shade device 200 is exposed to sun for less than 6 hours, between around 11 am to around 5 pm. In contrast, a majority of the playing surface of tennis court 100 without a retractable tennis court shade device is exposed to the sun for about 11 hours that same day, from 8 am to 7 pm. Over the day tennis court 100 with retractable shade device 200 has about five more hours of shade covering the majority of the playing surface as compared to tennis court 100 without retractable shade device 200.

Figures 5A, 5B, 5C, 5D, 5E, 5F, 5G, 5H, 5I, 5J, 5K, 5L, 5M, 5N:
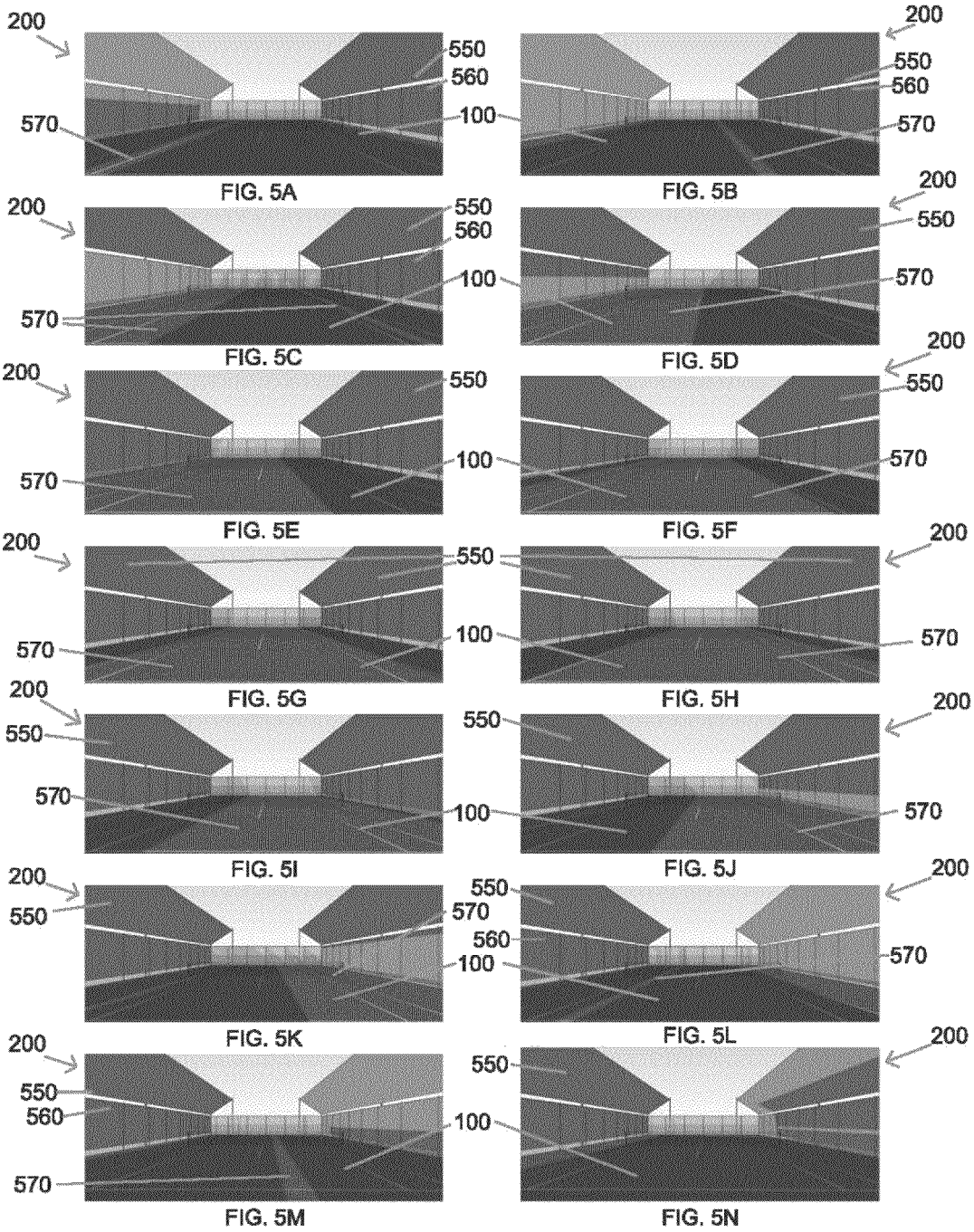
FIGS. 5A to 5N depict a simulation of the shading on a tennis court equipped with a retractable tennis court shade device according to one embodiment of the invention located in Washington DC on Jun. 21, 2012 on a sunny day, showing the shading on the court over the day.

FIGS. 5A to 5N depict a simulation of the shading on a tennis court 100 located in Washington DC on Jun. 21, 2012 on a sunny day equipped with a retractable tennis court shade device 200 according to one embodiment of the invention, showing the shading on the court over the day. Beginning at 7 am in FIG. 5A, tennis court 100 is substantially shaded, with a small portion of court 100 exposed to sun 570 shining through the opening between the top of fencing with windscreen 560 and the bottom of fabric shade panel 550. At 8 am in FIG. 5B, tennis court 100 remains substantially shaded, with a small portion of court 100 exposed to sun 570 shining through the opening between the top of fencing 560 and the bottom of fabric shade panel 550. At 9 am in FIG. 5C, the majority of tennis court 100 remains shaded from sun 570 shining through the opening between the top of fencing with windscreen 560 and the bottom of fabric shade panel 550. At this point in the day, sun 570 also begins shining on tennis court 100 through the opening above court 100. At 10 am in FIG. 5D, about half of tennis court 100 is shaded by fabric shade panel 550 from sun 570 shining through the opening above court 100. At 11 am in FIG. 5E, about one third of tennis court 100 is shaded by fabric shade panel 550 from sun 570 shining through the opening above court 100. By 12 pm in FIG. 5F, a small portion of tennis court 100 is shaded by fabric shade panel 550 from sun 570 shining through the opening above court 100. At 1 pm in FIG. 5G, very little of tennis court 100 is shaded by fabric shade panel 550 from sun 570 shining through the opening above court 100. At 2 pm in FIG. 5H, a small portion of tennis court 100 is shaded by fabric shade panel 550 from sun 570 shining through the opening above court 100. By 3 pm in FIG. 5I, about one quarter of tennis court 100 is shaded by fabric shade panel 550 from sun 570 shining through the opening above court 100. By 4 pm in FIG. 5J, slightly less than one half of tennis court 100 is shaded by fabric shade panel 550 from sun 570 shining through the opening above court 100. At 5 pm in FIG. 5K, about two thirds of tennis court 100 is shaded by fabric shade panel 550 from sun 570 shining through the opening above court 100. At 6 pm in FIG. 5L, tennis court 100 is substantially shaded by fabric shade panel 550 from sun 570 shining through the opening above court 100, with a small portion of court 100 exposed to sun 570 through the opening between the top of fencing with windscreen 560 and the bottom of fabric shade panel 550. At 7 pm in FIG. 5M, tennis court 100 is substantially shaded by fabric shade panel 550 with only a small portion of court 100 exposed to sun 570 shining through the opening between the top of the fencing with windscreen 560 and the bottom of fabric shade panel 550. By 8 pm in FIG. 5N, tennis court 100 is completely shaded. Thus, over the day, a majority of the playing surface of tennis court 100 was exposed to sun for about 6 hours, between around 10 am to around 4 pm. Before 10 am and after 4 pm tennis court 100 had shade covering the playing surface.

In the foregoing description, the present invention has been described with reference to specific exemplary embodiments thereof. It will be apparent to those skilled in the art that a person understanding this invention may conceive of changes or other embodiments or variations, which utilize the principles of this invention without departing from the broader spirit and scope of the invention. The specification and drawings are, therefore, to be regarded in an illustrative rather than a restrictive sense. Accordingly, it is not intended that the invention be limited except as may be necessary in view of the appended claims.

What is claimed is:

1. A playing surface shade device comprising:

a plurality of frame arms each comprising a proximal end and a distal end;

a plurality of base support columns:

disposed on a first side of a playing surface; and each comprising a top end and a bottom end, the top end coupled to the proximal end of each of the plurality of frame arms and the bottom end coupled to a ground surface;

a plurality of frame support columns:

disposed on a second side of the playing surface, the second side of the playing surface perpendicular to the first side of the playing surface; and coupled to the distal end of each of the plurality of frame arms; and at least one shade panel extending between the proximal end of each of the plurality of frame arms and the distal end of each of the plurality of frame arms and extending over a portion of the playing surface.

2. The playing surface shade device of claim 1, wherein the playing surface is a tennis court.

3. The playing surface shade device of claim 2, wherein the plurality of base support columns are substantially aligned parallel with at least one of a sideline and a baseline of the tennis court.

4. The playing surface shade device of claim 1, wherein the playing surface is not covered by any portion of the plurality of frame arms.

5. The playing surface shade device of claim 1, wherein the at least one shade panel are is retractable.

6. The playing surface shade device of claim 1, wherein the at least one shade panel is manually retractable.

7. The playing surface shade device of claim 1, wherein the at least one shade panel is made of a polypropylene mesh material.

* * * * *